US005242344A

United States Patent [19]

Hundley

[11] Patent Number: 5,242,344

[45] Date of Patent: Sep. 7, 1993

[54] LIMB MOVEMENT EXERCISING AND TRAINING APPARATUS

[76] Inventor: Kenneth W. Hundley, 9724 Variel Ave., Chatsworth, Calif. 91311

[21] Appl. No.: 606,500

[22] Filed: Oct. 31, 1990

[51] Int. Cl.[5] ..... A63B 21/06; A63B 69/36

[52] U.S. Cl. ..... 482/93; 482/100; 273/191 R

[58] Field of Search ..... 272/116, 117, 118, 93, 272/71, 124, DIG. 4; 273/191 R, 191 B, 190 R; 434/252

[56] References Cited

U.S. PATENT DOCUMENTS 2,626,151 1/1953 Jenks ..... 273/190 R
3,614,108 10/1971 Garten .
3,785,657 1/1974 Moller .
3,876,212 4/1975 Oppenheimer .
3,926,430 12/1975 Good, Jr. .
3,966,203 6/1976 Bickford .
4,229,002 10/1980 Masters .
4,249,762 2/1981 Richards .
4,261,573 4/1981 Richards ..... 273/191 R
4,333,644 6/1982 Lambert et al. ..... 272/118
4,381,111 4/1983 Richards .
4,583,738 4/1986 Fava .
4,583,740 4/1986 Ohly .
4,653,757 3/1987 Wilkinson .
4,709,920 12/1987 Schnell ..... 272/118
4,842,270 6/1989 Lange .
4,982,956 1/1991 Lapcevic ..... 272/118

*Primary Examiner*—Stephen R. Crow
*Attorney, Agent, or Firm*—Spensley Horn Jubas & Lubitz

[57] ABSTRACT

A limb movement exercising and training apparatus having a cable connected, at one end, to a weight plate and connected, at the other end, to a rotatable cam rail. A pivotal swing arm is connected to the cam rail to rotate the cam rail upon pivotal motion of the swing arm. Rotation of the cam rail pulls the cable and lifts the weight plate. A handle, or other suitable structure, is connected to the swing arm so as to pivot the swing arm and rotate the cam rail as a user moves a limb in an exercise or training motion. The outer peripheral shape of the cam rail and/or the location of the axis of rotation of the cam rail may be designed to require varying amounts of work or power to rotate the cam rail as the cam rail is rotated by varying degrees of rotation. Adjustment structure allows the height and angle of the cam rail and swing arm to be adjusted.

26 Claims, 4 Drawing Sheets

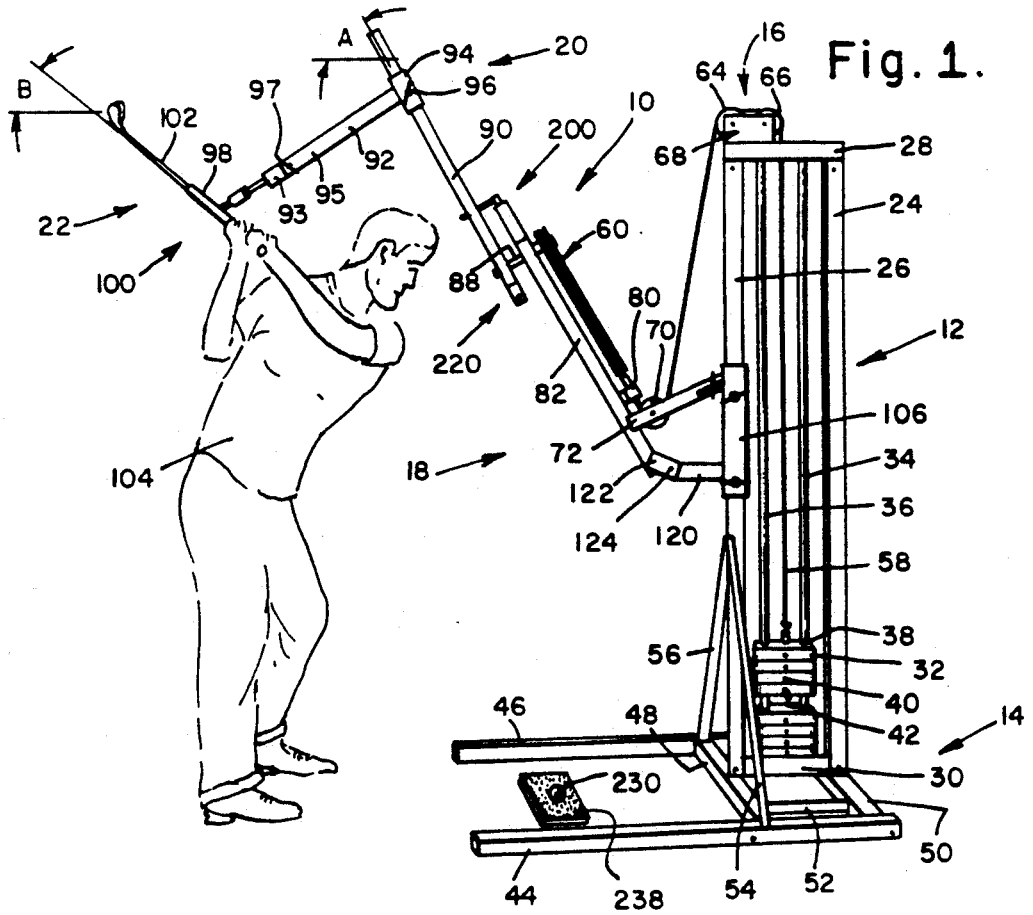
Fig. 1.
Fig. 2.
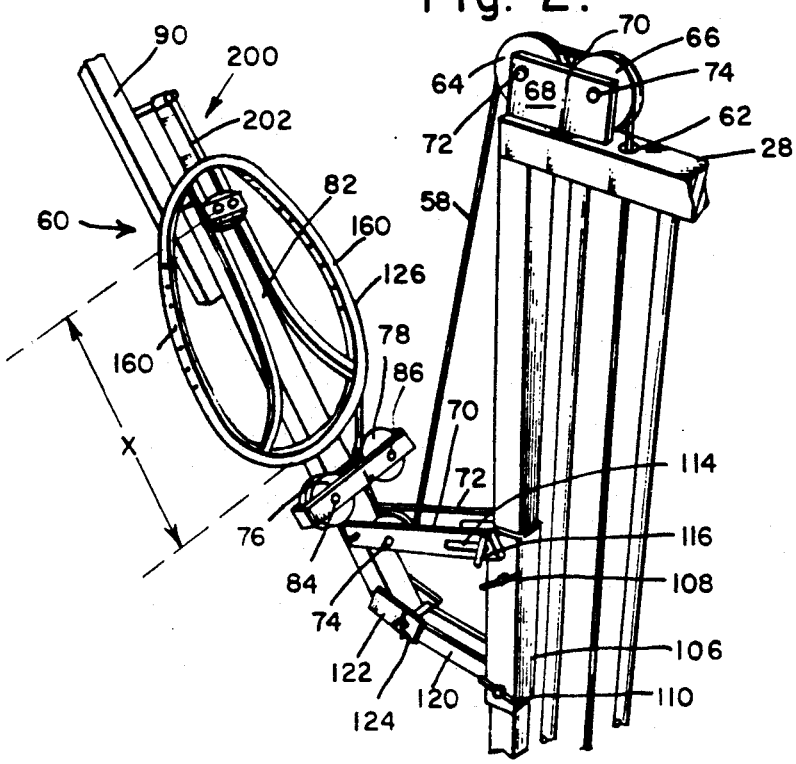

LIMB MOVEMENT EXERCISING AND TRAINING APPARATUS

BACKGROUND OF THE INVENTION

1. Field of the Invention

The present invention relates to a limb movement exercising and training apparatus, and more particularly, to an apparatus for exercising or training arm, leg and body muscles for emulating specific athletic movements or for physical therapy activities.

2. Description of Related Art

Various exercising devices for exercising body and limb, e.g., leg or arm, muscles are known in the art. For example, typical bar-bells or weight bars have been known and used for quite some time. These devices generally include a set of disk shaped weight members, commonly referred to as free weights, and a bar on which the disk shaped weight members are supported. One can exercise and build muscle tone over a period of time by lifting the bar in various lifting motions.

Other, more sophisticated apparatuses have been developed, including exercise apparatuses which include a cable connected to a vertical rack of weight plates and, through linkage devices, to a bar or handle. The bar or handle can be lifted or pulled resulting in a pulling tension applied to the cable which causes the cable to pull and lift a selected number of weights within the vertical weight rack.

In such known weight-type devices, weights are lifted as a user lifts, pushes, pulls, or otherwise moves a bar or other mechanism. As the weights are lifted, a resistance is felt by the user resulting from gravitational force acting on the weights and countering the users lift or stroke motion. The user must exert an amount of "work" to lift the weight (work being equal to the product of the force acting in the direction of motion and the distance through which it acts). The amount of power required to lift the weight is equal to amount of work per unit of time. It is often beneficial for a weight-type exercising device to provide a greater resistance (and require a greater amount of work or power) during portions of a lift or stroke and a reduced resistance during other portions of the lift or stroke. The greater resistance portions of the lift or stroke can be employed for working certain muscles or working certain portions of muscle movements to a greater degree and to allow the user to concentrate more on building muscle strength. The reduced resistance portions of the lift or stroke can be employed for working certain muscles or portions of muscle extensions at a reduced degree and to allow the user to concentrate more on movement form.

A common problem associated with some typical weight-type devices is that the resistance provided by the weights remains constant throughout the entire lift or stroke. In other devices, the resistance may vary in a preset, unalterable manner over the entire stroke; that is, the points of minimum or maximum resistance remain fixed and are not adjustable. As a result a user is restricted to exercise or train according to the unalterable resistance pattern which was preset by the manufacturer of the exercise apparatus.

SUMMARY OF THE INVENTION

The present invention relates to a limb movement exercising and training apparatus and components thereof which allow a user, or another person, to adjust the location(s) or portion(s) of the user's limb stroke at which relatively large or small resistances to the limb movement will be applied. According to an embodiment of the invention, apparatus (or a method) is provided to resist a user's limb motion. The resistance is controlled to provide a relatively large resistance during a first portion of the limb motion and a relatively small resistance during a second portion of the limb motion. Apparatus (or a method) is provided to adjust the position, with respect to the limb motion, at which the relatively large resistance and the relatively small resistance is provided. These features may be provided by, for example, the apparatus shown in the embodiment illustrated in FIGS. 1-8. The illustrated embodiment of the invention is a unique limb movement exercising and training apparatus and components thereof which are designed for exercising and training muscle groups employed during a person's limb and body movements for a golf club stroke. Other embodiments are designed for exercising and training muscle groups employed during limb or body movements for other sporting or therapeutic activities.

The illustrated apparatus includes a weight rack for supporting a set of weight plates. A selector bar and pin mechanism allows a user to select a single or a number of weight plate(s) and, thus, a total amount of weight which the user desires to employ.

The illustrated apparatus also includes a cable having a first end connected to the selected weight plate(s) and a second end connected to the outer periphery of a cam wheel structure. A cable guide comprising rotatable pulleys guides the cable portion extending between the selected weight plate(s) and the cam wheel. The cam wheel is supported by a cam axle for rotation about a cam axis. Rotation of the cam wheel about the cam axis pulls the cable which lifts the selected weight plate(s). The number of weight plates selected (thus, the amount of weight selected) determines the resistance force resisting the pulling tension applied to the cable by the cam wheel rotation and, thus, the rotation of the cam wheel.

A pivotal swing arm is connected to the cam axle for pivotal motion about the cam axis. Pivotal motion of the swing arm rotates the cam axle and the cam wheel. Linkage apparatus for transferring the arm motions of a golf club stroke into a swinging motion of the swing arm is connected to the swing arm (other embodiments are designed for transferring other types of arm motions or leg motions, such as arm swings for a tennis racket stroke, baseball bat stroke, polo club stroke, pitch stroke, swim stroke, or the like, or a leg swing, such as for a kick stroke, a running stroke, swim stroke, or the like). The arm stroke motion transfers to a pivoting or swinging motion of the swing arm. The pivoting or swinging motion of the swing arm rotates the cam wheel and, thus, pulls on the cable to lift a selected number of weight plate(s) within the weight rack.

The cam wheel is rotated about a cam axis which may be eccentrically located with respect to the cam wheel. Additionally, the cam wheel may be provided with a peripheral contour which, independently or in conjunction with the location of the cam axis, pulls the cable by a varying amount per degree of rotation of the cam wheel. The specific location of the cam axis of rotation (with respect to the cam wheel) and/or the specific peripheral shape of the cam wheel may be designed to, e.g., pull a greater length of cable per degree of rotation during a specific portion or portions of the cam wheel rotation and a smaller length of cable during another portion or other portions of the cam wheel rotation. As a result, the amount of work required to pivot the swing arm about the cam axis may be varied over the full stroke of the limb swing.

The location of the cam axis of rotation and the peripheral shape of the cam wheel may be designed to provide greater or lower degrees of resistance to pivotal motion of the swing arm during selected portions of the limb stroke such that muscles acting during selected portions of the limb stroke may be worked to a greater extent than during other portions of the limb stroke. As a result, muscles can be trained to work harder during selected portions of the limb stroke, e.g, the downswing portion of a golf club stroke, to build strength and power during such selected portions of the limb stroke. During other selected portions of the limb stroke, e.g., the follow-through portion of a golf club stroke, the location of the cam axis and the peripheral shape of the cam wheel may be designed to pull a relatively small length of cable per degree of cam wheel rotation, resulting in a relatively lower degree of resistance to the cam wheel rotation and swing arm movement. These lower resistance portions of the limb stroke may be used to practice and perfect the movement form of the limb stroke. In an embodiment of the invention, the points of greater or reduced degrees of resistance over the limb stroke can be adjusted by adjusting the rest position of the cam wheel (the position of the cam wheel just prior to the start of a limb stroke).

The cam wheel and swing arm structures are supported by a support arm structure mounted to and extending from the weight rack. The height at which the support arm extends from the weight rack and the angle at which the support arm extends from the weight rack are adjustable via an adjustment structure. The adjustment structure includes a slider connected to the support arm and supported for sliding movement on a vertical frame portion of the weight rack. The adjustment structure also includes a hinged support for pivotally connecting the support arm to the weight rack. The adjustment structure further includes lock mechanisms for locking the slider at a selected height along the vertical frame portion of the weight rack and for locking the support arm at a selected pivot angle. The adjustment structure allows the apparatus to be adjusted to adjust the plane in which the swing arm pivots and to accommodate persons of various heights and to accommodate or simulate different types of sports equipment, e.g. different lengths of golf clubs.

BRIEF DESCRIPTION OF THE DRAWINGS

The detailed description of the invention will be made with reference to the accompanying drawings, wherein like numerals designate corresponding parts in the several Figures.

FIG. 1 is a perspective view of a golf swing exercising apparatus according to an embodiment of the invention.

FIG. 2 is a perspective view of the cam wheel portion and cable guide structure employed in the apparatus shown in FIG. 1.

DESCRIPTION OF THE PREFERRED EMBODIMENTS

Figure 3:
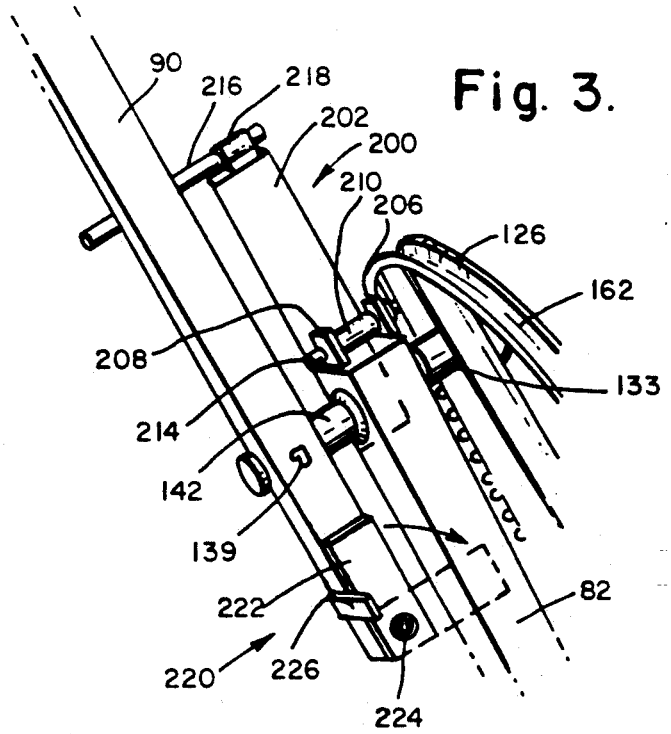
FIG. 3 is a perspective view of first and second swing arm stop mechanism structures employed in the apparatus shown in FIG. 1.

The following detailed description is of the best presently contemplated mode of carrying out the invention. This description is not be taken in a limiting sense, but is made merely for the purpose of illustrating the general principles of the invention. The scope of the invention is best defined by the appended claims.

The present invention relates to a limb stroke exercising and training apparatus for exercising and training body and limb muscles employed in typical sporting activities. Such limb strokes may include arm swings for a golf club stroke, arm swings for a baseball bat stroke, arm swings for a tennis racket stroke, arm swings for a polo club stroke, arm swings for a baseball throw or pitch, arm swings involved in swimming, boxing or martial arts, or arm swings involved in other types of sporting activities. The apparatus can also be adapted for exercising and training leg movements, such as a kicking stroke, a running stroke, a walking stroke, a swimming stroke, or the like. As will be apparent from the description below, the apparatus can be designed for improving and training a limb stroke for a sporting activity, as well as for improving and training a limb stroke for medical or therapeutic purposes.

The illustrated embodiment of the invention is directed to a golf swing stroke exercising and training apparatus. However, as mentioned above, and as will be described in more detail below, the apparatus can be designed and/or modified to accommodate various other limb strokes for various sporting and/or therapeutic activities.

FIG. 1 shows a golf swing exercising and training apparatus according to an embodiment of the invention. The illustrated golf swing exercising and training apparatus 10 includes a weight rack structure, generally indicated at 12, a weight rack support structure, generally indicated at 14, a cable and cable guide structure, generally indicated at 16, an angle and height adjustment structure, generally indicated at 18, a multiple arm structure, generally indicated at 20, a cam wheel structure, generally indicated at 60, and a handle structure, generally indicated at 22, as well as two stop mechanism structures, generally indicated at 200 and 220, respectively. Embodiments of each of these structures and of the operation of the apparatus are discussed in further detail below.

The weight rack structure 12 includes several liftable weight plates. The weight rack support structure 14 supports the weight rack structure 12 in a vertical position. The cable and cable guide structure 16 includes a cable connected at a first end to a weight plate and connected at a second end to the cam wheel structure 60. The multiple arm structure 20 is connected to the handle structure 22 and to the cam wheel structure 60 and conveys a user's golf stroke motion to a rotation motion of the cam wheel structure. Rotation of the cam wheel pulls the cable and lifts the weight plate connected to the cable. The two stop mechanism structures 200 and 220 selectively restrict motion of the multiple arm structure.

The Weight Rack Structure

The weight rack structure 12 includes a framework composed of a first vertical frame member 24 and a second vertical frame member 26. The framework also includes an upper horizontal frame member 28 which connects the upper ends of the first and second vertical frame members 24 and 26, respectively, and a lower horizontal frame member 30 which connects the lower ends of the first and second vertical frame members 24 and 26, respectively. Preferably, frame members 24, 26, 28 and 30 are composed of chrome plated, hollow, metal, tubular members (such as the square tubular members shown in FIG. 1). Alternatively, frame members 24, 26, 28 and 30 may be composed of any other suitable structures, including hollow or solid cylindrical members, and may be made of any suitable materials, including high-strength polymers or wood. Frame members 24, 26, 28 and 30 provide a rectangular framework in which a stack of weight plates 32 are located.

Each weight plate 32 comprises a rectangular plate made of a durable and massive material, such as cast iron, steel, or the like. However, other types of suitable weight members (such as sand filled plastic shells, etc.) may be used as an alternative to metal weight plates. First and second vertical guide bars 34 and 36, respectively, extend vertically within the framework, from the lower horizontal frame member 30 to the upper horizontal frame member 28. Preferably, guide bars 34 and 36 are composed of chrome plated, hollow, metal, cylindrical tubes. However, guide bars 34 and 36 may be composed of any other suitable structures and materials. First and second vertical guide bars 34 and 36, respectively, extend through respective apertures provided in each weight plate 32 such that the weight plates are slidable and moveable along the length of the first and second guide bars 34 and 36, respectively. The guide bars 34 and 36 guide the weight plates through a vertical motion within the framework.

A selector rod 38 extends through a center aperture provided through the center of the top surface of each weight plate 32. While not shown in detail in the figures, the selector rod 38 comprises a cylindrical shaped rod having a plurality of apertures therein along its length. However, any other suitable shaped structure can be used as an alternative to cylindrical shaped rod 38.

Each weight plate 32 has a side surface provided with a side aperture or groove 40. A removable selector pin 42 is insertable within the aperture or groove 40 of any one of the weight plates 32. The selector pin 42 has a length sufficient to extend into the side aperture or groove 40 and into an aperture provided in the selector rod 38. A user may insert the selector pin 42 into an aperture or groove 40 of a selected weight plate to, thereby connect the selected weight plate and all weight plates above the selected weight plate to the selector rod so as to select a weight amount.

Specifically, insertion of selector pin 42 into aperture or groove 40 of the top weight plate, thereby, selects the weight amount defined by the top weight plate (the weight amount of the top weight plate). Insertion of selector pin into aperture or groove 40 of the second to the top weight plate selects a weight amount equal to the weight of top weight plate plus the second to the top weight plate. Similarly, placing the selector pin 42 into aperture or groove 40 of the fourth from the top weight plate (as shown in FIG. 1) selects a weight amount equal to the total weight of the four top weight plates added together.

The Weight Rack Support Structure

The weight rack structure 12 is supported by a weight rack support structure generally indicated at 14. Support structure 14 includes first and second horizontal stabilizer feet 44 and 46, respectively and first and second base members 48 and 50, respectively. The first and second base members 48 and 50, respectively, extend between and attach the first and second stabilizer feet 44 and 46 together.

Horizontal stabilizer feet 44 and 46 and the base members 48 and 50 lie flat on a horizontal surface, such as a floor, a paved surface, or the ground. Base members 48 and 50 are connected, at their ends, to the stabilizer feet 44 and 46. First and second vertical frame members 24 and 26 extend from a central portion of first and second base members 48 and 50, respectively. Additional brace members 52 can extend between the first and second base members 48 and 50, respectively, to provide additional structural strength. Angle braces 54 and 56 extend, at an angle, from a location along the height of second vertical frame member 26 to the first and second stabilizer feet 44 and 46, respectively, to provide additional structural support for supporting the weight rack structure 12 in a vertical orientation as shown in FIG. 1. Preferably, stabilizer feet 44 and 46, base members 48, 50 and 52 and braces 54 and 56 are each composed of chrome plated, metal, hollow, square tubular members, as shown in FIG. 1. However, any other suitable structures or materials can be used for stabilizer feet 44 and 46, base members 48, 50 and 52 and braces 54 and 56, including solid or hollow cylindrical members.

The Cable and Cable Guide Structure

A cable 58 is connected to and extends between selector rod 38 and a cam wheel 60. Cam wheel 60 will be described in more detail below. A portion of cable 58 extends vertically within the framework formed by first and second vertical frame members 24 and 26, respectively, and upper and lower horizontal frame members 28 and 30, respectively. Cable 58 extends through an aperture 62 in upper horizontal frame member 28 and is guided by a cable guide arrangement, generally indicated at 16, to cam wheel 60.

The cable guide arrangement comprises first, second, third, fourth and fifth pulleys, best illustrated in FIG. 2. Referring to FIG. 2, first and second pulleys 64 and 66, respectively, are rotatably supported by a pulley bracket 68 mounted on the top surface of upper horizontal frame member 28. Pulley bracket 68 comprises a plate 70 mounted vertically on the upper surface of upper horizontal frame member 28. First and second pulley axles 72 and 74, respectively, extend horizontally from plate 70 and support first and second pulleys 64 and 66, respectively, for rotation. Pulley bracket 68 may include a second plate (not shown) located on the opposite side of first and second pulleys 64 and 66, respectively, with respect to the side at which plate 70 is located. Cable 58 extends through aperture 62 and over first and second pulleys 64 and 66 and is guided in an inverted "U"-shaped path around pulleys 64 and 66.

A portion of cable 58 extends between first pulley 64 and a third pulley 70. Third pulley 70 is rotatably supported by a third pulley axle 74. Third pulley axle 74 is supported, in a horizontal orientation, by a first adjustment arm 72 (which will be described in further detail below). Cable 58 is guided in a "U"-shaped cable path around third pulley 70.

Cable guide 16 further includes fourth and fifth pulleys 76 and 78, respectively. A pulley bracket 80 is mounted to a support arm 82 (which will be described in more detail below) and comprises a rectangular band in which the fourth and fifth pulleys 76 and 78 are arranged. Pulley bracket 80 supports fourth and fifth pulley axles 84 and 86, respectively. Fourth and fifth pulleys 76 and 78 are rotatably supported by fourth and fifth pulleys axles 84 and 86, respectively. A portion of cable 58 extends from third pulley 70, contacts one of the fourth and fifth pulleys 76 and 78, respectively, (FIG. 2 shows cable 58 contacting fifth pulley 78) and connects to a peripheral surface of cam wheel 60.

The Multiple Arm Structure

A multiple arm structure 20 is supported by second vertical frame member 26. Structure 20 includes a support arm 82 supported at an angle, with respect to the horizontal, by an angle and height adjustment structure generally indicated at 18 (and which will be described in further detail below). Cam wheel 60 is rotatably supported by support arm 82. Specifically, cam wheel 60 is fixed to a cam axle 88 which extends through support arm 82 in a manner which will be discussed in further detail below with reference to FIG. 7. Preferably, support arm 82 is composed of a chrome plated, hollow, metal, square tubular member as shown in FIG. 1. However, other suitable structures and materials can be used for support arm 82, including a hollow or solid cylindrical member.

A swing arm 90 is fixed to cam axle 88 on the opposite side of support arm 82 with respect to the side at which cam wheel 60 is supported. Swing arm 90 and cam wheel 60 are fixed to respective opposite ends of cam axle 88 such that a pivotal or swinging motion of arm 90 about the axis of cam axle 88 causes cam axle 88 and cam wheel 60 to rotate about the axis of cam axle 88. Swing arm 90 is supported substantially parallel to support arm 82 and is arranged at an angle A with respect to the horizontal. The angle A is dependent upon the angle of support arm 82 with respect to the horizontal. As will be described in further detail below with respect to the angle and height adjustment structure 18, the angle of support arm 82 with respect to the horizontal (and, thus, the angle A) is adjustable. Preferably, swing arm 90 is composed of a chrome plated, hollow, metal, square tubular member as shown in FIG. 1. However, other suitable structures and materials can be used for swing arm 90, including a hollow or solid cylindrical member.

A handle connecting arm 92 is supported by swing arm 90, substantially at a right angle to swing arm 90, by a slider mechanism 94. Preferably, handle connecting arm 92 is composed of two tubes in a telescoping arrangement, with one tube 93 slidably provided partially inside of another tube 95 and slidable along the length of tube 95. A torque bolt 97 extends through tube 95 and contacts tube 93 (or a pressure plate, not shown) to fix tube 93 in a selected position with respect to tube 95. Accordingly, the length of connecting arm 92 is selectively adjustable. Preferably, tubes 93 and 95 each are composed of a chrome plated, hollow, metal, square tubular member as shown in FIG. 1. However, other suitable structures and materials can be used for tubes 93 and 95, including cylindrical members.

Slider mechanism 94 comprises a hollow tubular member through which swing arm 90 extends and which is slidable along the length of swing arm 90. A torque bolt 96 is threadably secured to the tubular member of slider 94 and can extend through slider 94 to contact swing arm 90 (or to contact a pressure plate, not shown, as discussed in further detail below). Torque bolt 96 can be threaded through slider 94 and frictionally contact swing arm 90 (or a pressure plate, not shown) to fix slider 94 at a selected location along the length of swing arm 90. In this manner, the location at which handle connecting arm 92 extends from swing arm 90 is adjustable along the length of swing arm 90. Torque bolt 96 (like other torque bolts described in the specification) may be provided with a convenient, user operable handle. In an embodiment of the invention, torque bolt 96 may be loosened and slider 94 may be slid off of swing arm 90 so as to remove the handle connecting arm 92 from the apparatus. The golfer will then be able to swing an ordinary golf club (not shown) while remaining in front of the apparatus 10 without employing the swing arm, cam wheel and weight rack of the apparatus.

A handle 98 is connected to handle connecting arm 92 by handle support structure, generally indicated at 100 and described in further detail below with respect to FIGS. 4 and 6. In an embodiment of the invention, a golf club shaft 102 extends from one end of handle 98. As will be discussed in further detail below, the angle B of shaft 102 with respect to the horizontal may be freely variable or may be fixed, as will be discussed below with reference to FIGS. 4 and 6. As shown in FIG. 1, shaft 102 extends from one side of handle 98 while an operator (hereinafter referred to as the golfer) 104 grips the handle near the other end thereof. Handle support structure 100 connects to handle 98 at a location between the location at which golfer 104 grips the handle and the handle end from which shaft 102 extends.

The Angle and Height Adjustment Structure

The cam and multiple arm structure, generally indicated at 20, and the handle structure, generally indicated at 22, are connected to the second vertical frame member 26 by an angle and height adjustment structure, generally indicated at 18. Structure 18 is best shown in FIG. 5.

Figure 5:
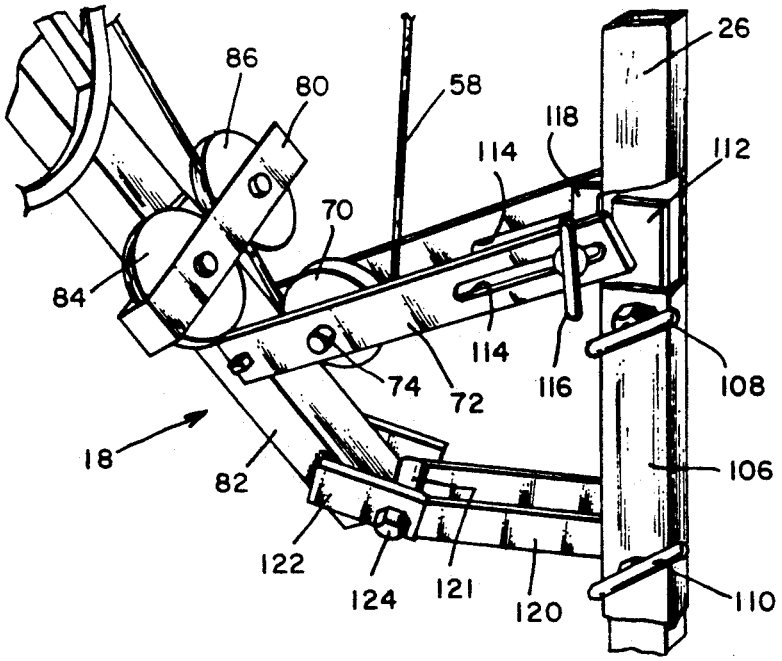
FIG. 5 is a perspective view of an angle and height adjustment structure employed in the apparatus shown in FIG. 1.

Referring to FIG. 5, structure 18 includes a vertical slider 106 supported by and slidable along the length of second vertical frame member 26. Vertical slider 106 is composed of a hollow tubular member through which second vertical frame member 26 extends. However, other suitable structures, e.g. a "U"-shaped bracket structure or the like, may be used as an alternative to a tubular member. A projection 118 extends from vertical slider 106 to connect first adjustment arm 72 to vertical slider 106 in a manner as discussed in further detail below. Torque bolts 108 and 110 are threadably secured to vertical slider 106 and extend through vertical slider 106 to contact second vertical frame member 26. In this manner torque bolts 108 and 110 can be threaded through vertical slider 106 and frictionally contacted with second vertical frame member 26 to fix vertical slider 106 at a selected location along the length of second vertical frame member 26. Accordingly, the height of vertical slider 106 and, therefore, the height of the cam and multiple structure 20, can be selected and fixed along the length of second vertical frame member 26.

In a preferred embodiment, a pressure plate 112 extends between an exterior surface of vertical frame member 26 and an interior surface of slider 106 such that torque bolts 108 and 110 contact pressure plate 112, rather than vertical frame member 26. Pressure plate 112 provides the function of prohibiting torque bolts 108 and 110 from making physical contact with second vertical frame member 26. As a result, torque bolts 108 and 110 will not dent, scratch or otherwise mar second vertical frame member 26. Pressure plate 112 also functions to distribute pressure imparted by torque bolts 108 and 110 over a relatively large surface area, defined by the surface of pressure plate 112 which contacts second vertical frame member 26. Distribution of pressure, as provided by pressure plate 112, also helps protect second vertical frame member 26 from being dented, scratched or marred by pressure exerted by torque bolts 108 and 110.

Torque bolts 108 and 110 may be threaded through slider 106 to contact pressure plate 112 and press pressure plate 112 against vertical frame member 26. As a result, a frictional engagement between the pair of torque bolts 108 and 110 and pressure plate 112 and also between pressure plate 112 and second vertical frame member 26 will fix vertical slider 106 at a selected location along the length of second vertical frame member 26. A similar pressure plate (not shown) may be arranged between slider 94 and swing arm 90 and another similar pressure plate (not shown) may be arranged between tubes 93 and 95 of handle connecting arm 92. As an alternative embodiment, vertical frame member 26 (or swing arm 90 or tube 93) may be provided with a plurality of apertures along its length, through which torque bolts 108 and 110 (torque bolt 96 or torque bolt 97) may selectively extend to fix slider 106 (slider 94 or tube 93) at any one of a plurality of selectable locations along the length of vertical frame member 26 (swing arm 90 or tube 95).

An adjustment arm 72 is supported by vertical slider 106, extends from the vertical slider, and is attached at its extended end to support arm 82. As shown in FIG. 5, adjustment arm 72 is composed of two plates extending from vertical frame member 26 to support arm 82. Each plate of adjustment arm 72 is connected at one end to support arm 82 and has an elongated slot 114 adjacent second vertical frame member 26. Third pulley 70 is supported between the two plates of adjustment arm 72 by third pulley axis 74 extending between the two plates.

A torque bolt 116 extends through each elongated slot 114 in the two plates of adjustment arm 72. Torque bolt 116 also extends through an aperture (not shown) in projection 118 of vertical slider 106 to thereby connect adjustment arm 72 to vertical slider 106. Slots 114 allow adjustment arm 72 to be moved in a direction traverse to the vertical length of second vertical frame member 26, while allowing torque bolt 116 to secure adjustment arm 72 to vertical slider 106 at a selected position with respect to second vertical frame member 26. Preferably, adjustment arm 72 is composed of a pair of chrome plated, metal, plate members as shown in FIG. 1. However, other suitable structures and materials can be used for adjustment arm 72, including a single plate or bar structure, or the like.

A hinge support structure 120 is fixed with respect to, and extends at substantially a right angle from vertical slider 106 toward support arm 82. A hollow tube 121 is fixed to the end of structure 120 which is extended from slider 106. Preferably, hinge support 120 is composed of a chrome plated, hollow, metal, square tubular member as shown in FIG. 1. However, other suitable structures and materials can be used for hinge support 120, including a solid or hollow cylindrical member.

A pair of support arm plates 122 are fixed to the lower end of support arm 82 and pivotally connect with hinge support 120 by pivot bolt 124 extended through tube 121. In this manner, support arm 82 is pivotally connected to hinge support 120. Pivotal movement of support arm 82, about pivot bolt 124, will cause movement of adjustment arm 72 in a direction traverse to the vertical length of second vertical frame member 26. The position of support arm 82 can be locked, prohibiting pivotal movement about pivot bolt 124, by tightening torque bolt 116 extending through slots 114 and projection 118. The angle which support arm 82 makes with respect to the horizontal is, thereby adjustable and can be fixed at a desired angle. The angle of support arm 82, with respect to the horizontal, determines the angle of swing arm 90, with respect to the horizontal, and, thus, determines the angular orientation of the plane in which swing arm 90 pivots. Accordingly, the angular orientation of the plane in which swing arm 90 pivots is adjustable by virtue of the adjustability of the angle of support arm 82.

While the figures illustrate adjustment arm 72 and elongated slots 114 as having a length which allows adjustment of the angle of support arm 82 with respect to the horizontal in the range of approximately 30° to approximately 100°, it is noted that a longer adjustment arm 72 provided with longer slots 114 can provide a greater range of angles of support arm 82 with respect to the horizontal. Such greater range of angles or a different range of angles may be desired for an apparatus designed to be employed for exercising or training limb movements for sporting activities other than golfing.

The Cam Wheel Structure

Figure 7:
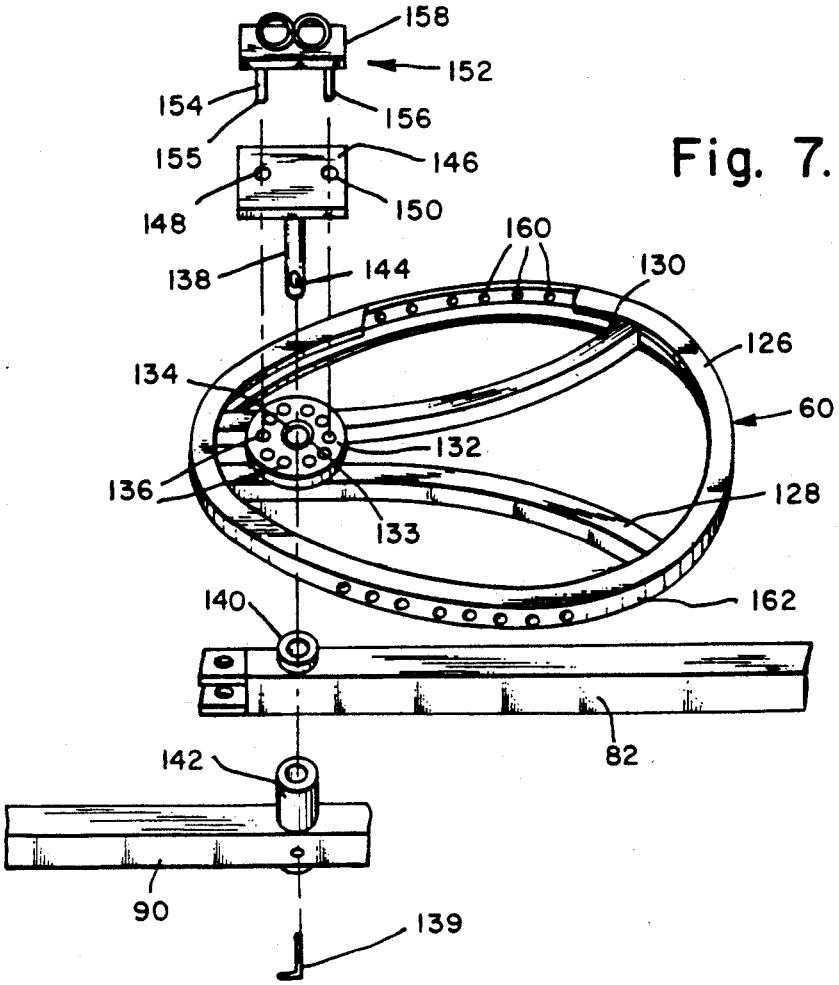
FIG. 7 is an exploded perspective view of a cam wheel structure employed in the apparatus of FIG. 1.

Cam wheel 60 and related connecting structure is best shown in the exploded view of FIG. 7. As will be described in further detail below, the cam wheel 60 and its connecting structure provide a unique adjustable resistance placement apparatus which allows the adjustment of the places or points along the cam wheel rotation (and the user's limb stroke) at which an increased or decreased resistance occurs. Referring to FIG. 7, cam wheel 60 includes an oval cam rail 126 having a first rib 128 and a second rib 130. Ribs 128 and 130 provide the cam structure with additional strength and a location for mounting a cam hub 132. The oval cam rail 126 has a relatively small radius of curvature on the left side of the rail shown in FIG. 7 (the small diameter portion) and a relatively large radius of curvature on the right side of the rail shown in FIG. 7 (the large diameter portion).

Cam hub 132 is fixed to a hollow tube 133 which is fixed, at its outer peripheral surface to first and second ribs 128 and 130, respectively, and is centered with respect to the small radius of curvature of rail 126. Cam hub 132 includes a central bore 134 and plurality of peripheral bores 136. Each peripheral bore 136 is located on the same diameter line (an imaginary line drawn across the diameter of cam hub 132) as another peripheral bore 136.

Cam rail 126 is rotatably supported by support arm 82. Additionally, swing arm 90 is pivotally supported by support arm 82. Pivotal support of cam rail 126 and swing arm 90, with respect to support arm 82, is accomplished by arranging a cam axle 138 through tube 133 and, thus, through the central bore 134 of cam hub 132, through an aperture 140 in support arm 82 and through an axle housing 142 extending from swing arm 90. Axle housing 142 is composed of a hollow cylindrical portion extending at a right angle from swing arm 90. Cam axle 138 is secured to swing arm 90 with an axle bolt 139 extending through swing arm 90 and into an aperture 144 of cam axle 138.

Cam axle 138 extends from an axle plate 146 which rests on the upper surface (with respect to FIG. 7) of cam hub 132. Axle plate 146 is provided with two apertures 148 and 150 which are spaced apart by a distance equal to the distance between two peripheral bores 136 disposed on the same diameter line of cam hub 132. In this manner, apertures 148 and 150 can be aligned with any pair of peripheral bores 136 lying on the same diameter line of cam hub 132 while cam axle 138 extends through central bore 134 of cam hub 132. As will be described below, the significance of the ability to align apertures 148 and 150 with any pair of peripheral bores 136 lying on the same diameter line of cam hub 132 allows cam rail 136 to be supported by support arm 82 in any one of a variety of starting positions while the apparatus is at a rest position.

A lock pin device 152 has a first pin 154 and a second pin 156 extending from a plate 158. The first and second pins 154 and 156, respectively, are spaced apart by a distance equal to the distance between apertures 148 and 150 of axle plate 146. First and second pins 154 and 156, respectively, have a length sufficient to extend through apertures 148 and 150, respectively, and into a pair of peripheral bores 136 located on the same diameter line of cam hub 132. In this manner, pins 154 and 156 of lock pin device 152 are inserted through apertures 148 and 150, respectively, and through two respective peripheral bores 136 to secure axle plate 146 and, thus, cam axle 138 to cam hub 132 and cam rail 126 in a manner such that lock pin device 152, axle plate 146, cam hub 132 and cam rail 126 are non-rotatable with respect to each other. Each pin 154 and 156, or only one pin 154 may be provided with a ball locking device 155 which includes a spring loaded ball partially extending from the pin, near the free end of the pin. In this embodiment, upon inserting pins 154 and 156 through apertures 148 and 150 and bores 136, the end(s) of the pin(s) having ball 155 will extend out from the lower side (with respect to FIG. 7) of hub 132 and ball 155 will impede the pin(s) from sliding out of bores 136.

Cam axle 138 extends through central bore 134 and through aperture 140 of support arm 82 and is rotatable within aperture 140 with respect to support arm 82. Cam axle 138 also extends from support arm 82 and into axle housing 142 of swing arm 90. A quick release pin 139 secures cam axle 138 to axle housing 142 and, thus, to swing arm 90 in a non-rotatable manner. As a result, swing arm 90 is mounted to support arm 82 to pivot or swing with respect to support arm 82 and to rotate cam rail 126.

Cam rail 126 is provided with a plurality of apertures 160 along both peripheral surfaces extending between the small diameter portion and the large diameter portion of the cam rail. Cable 58 is provided with a pin or hook 59 (FIG. 8) which is insertable in any one of apertures 160 to connect cable 58 to cam rail 126. A plurality of apertures 160 are provided on each peripheral surface portion of cam rail 126 between the small and large diameter portions of the cam rail so as to allow for adjustment to accommodate different cable lengths, different weight rack heights, different angle adjustments of support arm 92 and different starting orientations of cam rail 126 at the rest position. Cam rail 126 is provided with a C-channel configuration and has a groove 162 (FIGS. 3 and 7) extending about its entire outer periphery for receiving and guiding cable 58 as cam rail 126 is rotated.

Figure 8:
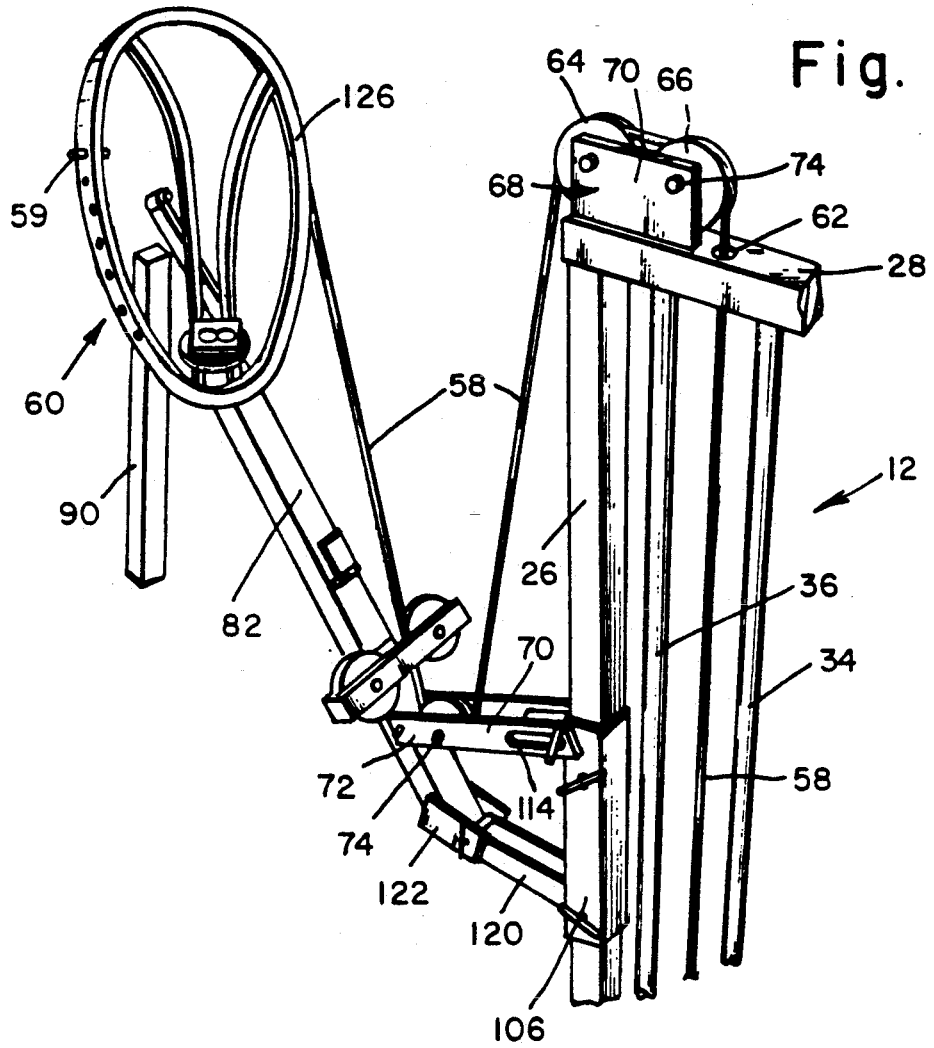
FIG. 8 is a perspective view of the structure shown in FIG. 2 after the cam wheel has been rotated approximately 150°.

Referring to FIGS. 2 and 8, cable 58 is connected to an aperture 160 located on the right side (with respect to FIG. 2) of cam rail 126 and abuts the fifth pulley 78 (on the right side of FIG. 2) for accommodating a right-handed golfer. Cable 58 would connect to an aperture 160 on the left (with respect to FIG. 2) of cam rail 126 and would abut fourth pulley 76 for accommodating a left-handed golfer.

With cable 58 connected to an aperture 160 and to weight plates 32 and extended without slack between plates 32 and cam rail 126, the cable applies a biasing force on cam rail 126 for biasing or forcing cam rail 126 into the position shown in FIG. 2; that is, cam rail 126 is biased into a position with its large diameter portion (the rail portion furthest away from the axis of rotation) located closer to fourth and fifth pulleys 76 and 78, respectively, than the small diameter portion (the rail portion closest to the axis of rotation). Additionally, swing arm 90 is, thereby biased or forced into a position, as shown in FIG. 2, to extend upward with respect to FIG. 2. This position of the apparatus is referred to as the rest position.

The Handle Structure

Figure 4:
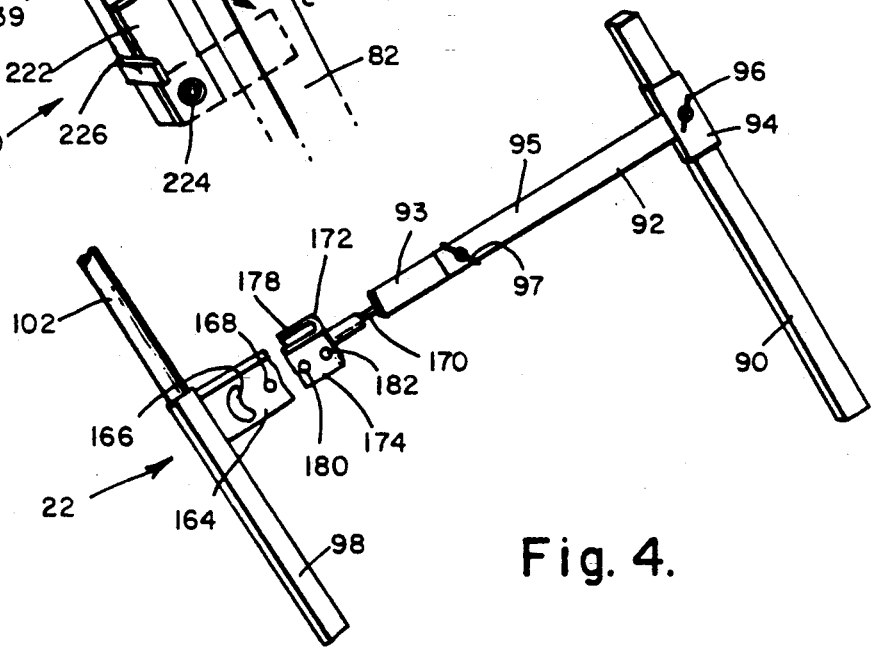
FIG. 4 is a perspective view of an embodiment of a handle structure operable with the apparatus shown in FIG. 1.

FIG. 4 shows an embodiment of a handle structure 22. Referring to FIG. 4, handle structure 22 includes a handle 98 having a bracket 164 extending at substantially a right angle therefrom. Bracket 164 includes an elongated, curved aperture 166 and a circular aperture 168.

Extending from handle connecting arm 92 is a rotatable shaft 170 threadably secured to handle connecting arm 92. Shaft 170 is rotatable with respect to handle connecting arm 92 about the axis of shaft 170. A fork member 172 extends from rotatable shaft 170. Fork member 172 has two plate like tines 174 and 178 respectively, each of which are provided with two apertures 180 and 182, respectively. Bracket 164 extends between tines 174 and 178. A first rivet or bolt (not shown) extends through aperture 182 of each tine 174 and 178 and through aperture 168 of bracket 164. In this manner, bracket 164 and, thus, handle 98, are rotatably secured to fork member 172. A second bolt or rivet (not shown) extends through apertures 180 in tines 174 and 178 and through elongated, curved aperture 166 in bracket 164. In this manner, the pivotal motion of bracket 164 and, thus, handle 98, with respect to fork member 172, is limited by the extent of the curvature of aperture 166. According to an embodiment of the invention, a torque bolt (not shown) extends through apertures 180 of tines 174 and 178 and through aperture 166 of bracket 164. The torque bolt can be tightened so as to fix handle 98 at a selected angle with respect to arm 92.

Figure 6:
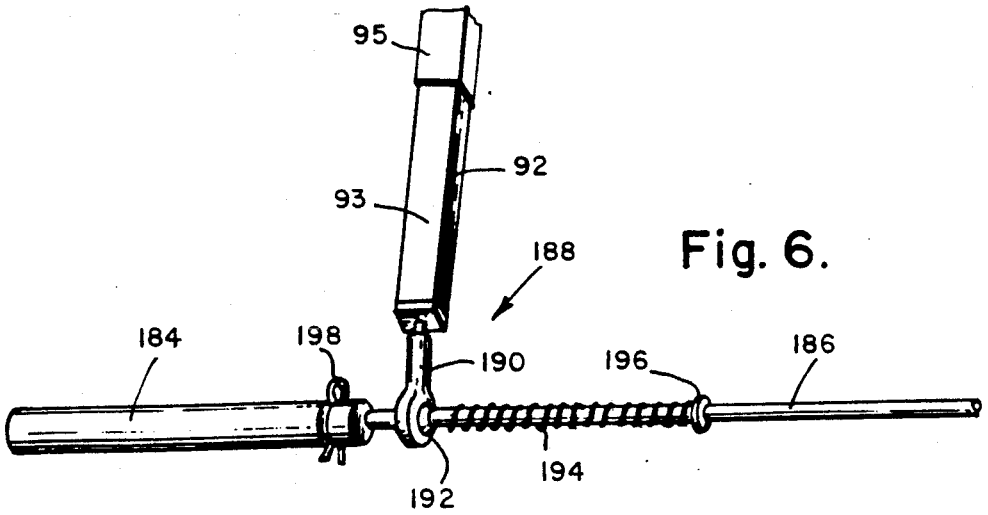
FIG. 6 is a perspective view of another embodiment of a handle structure operable with the apparatus shown in FIG. 1.

Another embodiment of a handle structure is shown in FIG. 6. In the FIG. 6 embodiment, a handle 184 is connected to a shaft 186. Handle 184 may be connected to shaft 186 by any suitable connection apparatus, such as a spring pin 198. Preferably, handle 184 is removable connected to shaft 186 for allowing ready replacement of a worn handle or to replace the handle 184 with one of a different size, shape or grip. Also connected to shaft 186 is a ball joint assembly generally indicated at 188. Ball joint assembly 188 includes a ball joint arm 190 and a ball joint 192. Ball joint 192 provides handle 184 and shaft 186 with a high degree of rotational and pivotal freedom with respect to ball joint arm 190. Ball joint arm 190 is threadably secured to handle connecting arm 92 and is rotatable with respect to handle connecting arm 92.

Shaft 186 is slidably fitted within ball joint ball 192 so as to allow shaft 186 to slide to the right and left with respect to FIG. 6. A spring 194 extends between ball joint 192 and a stop washer 196 fixed to shaft 186. Spring 194 biases shaft 186 to the right of FIG. 6. Alternatively, handle 184 (or handle 98) may comprise a telescoping tubular structure having a spring either internal or external to the tube structure to bias the telescoping tube structure toward fully extended state. The spring arrangements allow the handle to slide or move traversely to the length of arm 92 so that the golfers hands may take an imperfect circular path while swing arm 90 is pivoted in a circular path. This structure allows the golfer to more accurately simulate a golf stroke (or other athletic stroke) which does not form a perfect circle.

The First Stop Mechanism

FIGS. 2 and 3 show an embodiment of a first stop mechanism 200 which prohibits clockwise rotation of swing arm 90 in the clockwise direction (counterclockwise for left-handed golfers) from the rest position shown in FIG. 2. First stop mechanism 200, however, allows counter-clockwise (clockwise for left-handed golfers) rotation of swing arm 90 more than 360° from its position shown in FIG. 2 (the rest position). The ability of swing arm 90 to pivot counter-clockwise (clockwise for left-handed golfers as discussed below) more than 360° allows the golfer to emulate a full golf stroke including the full follow-through portion of the stroke.

Referring to FIG. 3, stop mechanism 200 includes a pivotal plate 202 pivotally connected to support arm 82 by a pivot mechanism, generally indicated at 204. Pivot mechanism 204 includes a first bracket 206 and a second bracket 208 extending from an end of support arm 82. A tube 210 is rotatably supported between brackets 206 and 208 and is secured to brackets 206 and 208 by, for example, pin 214. Tube 210 is fixed to pivotal plate 202 to allow pivotal motion of plate from its position shown in FIG. 2, in the counterclockwise direction with respect to FIG. 2. However, pivotal motion of pivotal plate 202, from its position shown in FIG. 2, in the clockwise direction with respect to FIG. 2, is prohibited by support arm 82 (see the broken line portion of pivotal plate 202 in FIG. 3).

The upper end of pivotal plate 202 is provided with a tube 218 fixed thereto. A stop rod 216, traversing the path of swing arm 90, is slidably supported within tube 218. As swing arm 90 rotates in the clockwise direction with respect to FIG. 2, swing arm 90 will contact and be stopped by stop rod 216 upon reaching the rest position shown in FIG. 3.

Pivotable plate 202 is mounted on the right side (with respect to FIG. 2) of support arm 82 shown in FIG. 2 for a right handed golfer. However, for a left handed golfer, pivotable plate 202 would be mounted on the left side (with respect to FIG. 2) of support arm 82 by releasing tube 210 from brackets 206 and 208, by placing pivotable plates 202 on the opposite side of support arm 82 (with respect to the side at which pivotable plate 202 is located in FIG. 3) and by securing tube 210 to brackets 206 and 208. Stop rod 216 would then be removed and inserted into the other end of tube member 218 so as to extend from the opposite edge of plate 202 (with respect to the edge from which it extends in FIG. 3) of pivotable plate 202. Stop rod 216 will, thereby, extend within the path of swing arm 90 to prohibit counterclockwise motion of swing arm 90, with respect to FIG. 2, after swing arm 90 reaches the rest position shown in FIG. 2.

The Second Stop Mechanism

FIG. 3 also shows an embodiment of a second stop mechanism, generally indicated at 220. Referring to FIG. 3, the second stop mechanism 220 includes a rectangular stop plate 222 pivotally mounted to swing arm 90 by a bolt 224. Stop plate 222 is mounted to swing arm 90 on the opposite side of axle housing 142 with respect to the side at which handle connecting arm 92 is attached to swing arm 90.

Stop plate 222 is pivotally mounted, via bolt 224, to swing arm 90 so as to be pivotal between a first position (shown as the solid line position in FIG. 3) and a second position (shown as the broken line position in FIG. 3). A tab 226 is fixed to swing arm 90 and provides an abutment against which stop plate 222 rests when in the first or second position. In the first position, the long sides of rectangular plate 222 are substantially parallel to the length of swing arm 90. As shown in FIG. 3, stop plate 222, when in the first position, does not interfere with the swinging motion of swing arm 90.

Stop plate 222 is pivotal about the axis of bolt 224 to the second position shown as the broken line position in FIG. 3. In the second position, the long sides of rectangular stop plate 222 extend substantially perpendicular to the length of swing arm 90. As shown in FIG. 3, stop plate 222, when in the second position, interferes with and prohibits the swinging motion of swing arm 90. With stop plate 222 in the second position, swing arm 90 is held substantially stationary, with respect to support arm 82, in the rest position between stop rod 216 and stop plate 222. When swing arm 90 is so held, cable 58 can be released from cam wheel 60, thereby releasing the biasing force which biases swing arm 90 toward stop rod 216, without allowing swing arm 90 to freely fall in the counterclockwise direction with respect to FIG. 3. Accordingly, swing arm 90 may be safely held in the rest position while cable 58 is released from cam wheel 60, e.g., during servicing, replacement or rearrangement of cam wheel 60 or to transfer the cable from the right to the left side (with respect to FIG. 2) of cam rail 125 for converting the apparatus from a right-handed apparatus. For left-handed use, either stop plate 222 may be released from the side of swing arm 90 facing out of the page in FIG. 3 and reattached on the opposite side of swing arm 90 or another stop plate (not shown) may be mounted on the opposite side of swing arm 90.

Operation

Prior to operation, the angle and adjustment structure is adjusted to accommodate the size of the golfer. Then cable 58 is connected to and extended between selector rod 38 of the weight rack and cam rail 126 with little or no slack existing in the cable. As a result, the tension of the cable maintains cam rail 126, and thus swing arm 90, in the position shown in FIGS. 1 and 2. This position is referred to as the rest position.

In operation, a golfer 104 grips the handle of handle structure 22 and swings the handle structure in the normal manner in which a golfer would swing a golf club handle. The swinging motion applied to handle structure 22 causes swing arm 90 to rotate, from the rest position, about the axis of cam axle 88 and, thereby causes cam wheel 60 to rotate about the axis of cam axle 88. In FIG. 1, a right handed golfer would swing handle structure 22 in a manner which would cause cam rail 126 shown in FIG. 2 to rotate counter-clockwise with respect to FIG. 2. However, a left-handed golfer would swing handle structure 22 to cause cam rail 126 shown in FIG. 2 to rotate clockwise with respect to FIG. 2.

Rotation of cam rail 126 causes the large diameter portion of the cam rail 126 to move to the right and up with respect to FIG. 2 and, thereby, pulls cable 58 to lift weight plates 32. The number of weight plates 32 lifted is dependent upon the location of selector pin 42. As weight plates 32 are lifted, the golfer 104 feels a resistance force countering the swinging motion. The amount of resistance force is dependent, in part, upon the number of weight plates 32 selected by selector pin 42 and, in part, on the length of cable 58 pulled for each degree of rotation of cam rail 126.

As cam rail 126 rotates and pulls cable 58, a length of cable 126 pulled from fourth or fifth pulleys 76 or 78, respectively, will lay within groove 162 of the cam rail. Thus, rotation of cam rail 126 causes a length of cable 58 to wrap around, at least partially, the periphery of cam rail 126, within groove 162. The length of cable 126 which is wrapped, or partially wrapped, around cam rail 126 for each degree of rotation of cam rail 126 (and thus for each degree of pivotal motion of swing arm 90) is dependent on the shape of the outer periphery of cam rail 126 and also on the location of the axis of rotation of cam rail 126. This concept is further explained with reference to FIGS. 2 and 8.

As shown in FIGS. 2 and 8, cable 58 is received from fourth or fifth pulleys 76 or 78 within groove 162 of cam rail 58 as the cam rail is rotated. The length of the cam rail groove which receives a corresponding length of cable 58 for each degree of cam rail rotation depends on the radius of curvature of that portion of the cam rail groove (and, thus depends on the size of the diameter of the corresponding portion of the cam rail). The greater the diameter of the portion of the cam rail periphery receiving cable 58 as the cam rail rotates, the greater the length of cable pulled and wrapped about the cam rail periphery for each degree of cam rail rotation. Thus, the diameter of each cable receiving portion of cam rail 126 affects the length of cable 58 pulled as the cam rail rotates.

Additionally, the location of the axis of rotation of cam rail 126 affects the length of cable 58 which is wrapped about the cam rail for each degree of rotation of the cam rail. With the axis of rotation of cam rail 126 eccentrically located (as shown in the Figures) the distance X from the axis of rotation to the location on the periphery of the cam rail at which cable 58 is received from fourth or fifth pulleys 76 or 78 will change as the cam rail is rotated. This distance X determines the arc of rotation which the cable receiving portion of cam rail 126 makes as the cam rail is rotated. With respect to each location of cam rail 126 which receives cable 58 from fourth or fifth pulley 76 or 78, the greater the distance X, the greater the arc of rotation and the greater the length of cable 58 pulled from fourth or fifth pulleys 76 or 78 for each degree of cam rail rotation. Thus, the location of the axis of rotation of cam rail 126 affects the length of cable 58 pulled for each degree of cam rail rotation.

Of course, the length of cable 58 pulled for each degree of cam rail rotation determines the amount at which the selected weight plate(s) are lifted for each degree of cam rail rotation. Therefore, the amount of work or power required to rotate cam rail 126 (and, thus, to pivot swing arm 90) depends, in part, on the amount at which the selected weight plate(s) are lifted for each degree of cam rail rotation. The amount of work or power to rotate cam rail 126 (and to pivot swing arm 90) also depends on the number of weight plates lifted. As discussed below, any one of or any combination of the shape of the outer periphery of cam rail 126, the location of the axis of rotation of the cam rail and the number of weight plates to be lifted can be designed and/or adjusted to suit particular needs of the user.

Additionally, the amount of work or power required to rotate cam rail 126 (and to pivot swing arm 90) may be varied over the course of the cam rail rotation and swing arm motion by virtue of the cam rail shape and the location of the cam rail axis of rotation. Thus, if it is desired that a relatively large amount of work or power be required to rotate cam rail 126 (and, thus to pivot swing arm 90) during the first few tens of degrees of rotation from the rest position, then the apparatus should be provided with a cam rail having a relatively large diameter portion and/or a relatively large distance X at the portion of the cam rail which receives cable 58 during the first few tens of degrees of rotation. Similarly, if, during another portion of the cam rail rotation, it is desired that a relatively small amount of work or power be required to further rotate cam rail 126 (and, thus to pivot swing arm 90), then the apparatus should be provided with a cam rail having a relatively small diameter portion and/or a relatively small distance X at the portion of the cam rail which receives cable 58 during such other portion of the cam rail rotation.

It will be recognized that cam rail 126 can be designed to require varying (or constant, if desired) amounts of work or power to rotate the cam rail (and, thus, to swing the swing arm 90) throughout the user's limb stroke. It will also be recognized that cam rail 126 can be designed to require a selected amount of relative work or power during each portion of the cam rail rotation (and, thus, during each portion of the swing arm pivotal motion) throughout the user's limb stroke.

With regard to a golf swing exercising and training device as shown in the Figures, a preferred cam rail design is shown at cam rail 126. Cam rail 126 shown in the Figures requires a relatively great amount of work to be expended during the first several tens of degrees of cam rail rotation from the rest position and a relatively small amount of work or power to be expended once the cam rail has been rotated approximately to the end of the down-swing portion of the stroke.

In this manner, golfer 104 must exert more power during most of the down-swing portion of the stroke and will exert less power during the end portion of the down-swing and through the follow-through portion of the golf stroke. This allows golfer 104 to concentrate on building strength during the down-stroke portion of the golf stroke and to concentrate on form and club alignment at the end portion of the down-swing and through the follow-through portion of the golf stroke. Accordingly, the golfer's specific arm and body muscles are exercised to a greater extent during the down-swing portion of the stroke while the golfer may concentrate on form during the follow-through portion of the stroke. Additionally, since a greater amount of work or power is required during the down-stroke portion of the stroke, the golfer will become accustomed to applying a greater force during the downstroke portion than during the follow through portion of a golf stroke. Of course, cam rail 126 can be designed to accommodate any particular golfers needs.

The portion(s) of the golf stroke at which a relatively great (or small) amount of power is required may be adjusted to a desired format by replacing cam rail 126 with another cam rail having the outer peripheral shape and the location of rotation axis which effects the desired format. Alternatively, adjustments can be made by repositioning the orientation of cam rail 126 at its rest position such that the relative small or large diameter portions of the cam rail and the distances X are repositioned, with respect to the rest position. Such repositioning of the orientation of cam rail 126 is accomplished by the steps of releasing cable 58 from an aperture 160 of cam rail 126, removing lock pin device 152 from a pair of bores 136, rotating cam rail 126 to a new orientation, reinserting lock pin device 152 into another pair of bores 136 and reconnecting cable 58 to another aperture 160 of cam rail 126. With cam rail 126 repositioned to a new orientation, the points or locations, with respect to the cam wheel rotation, at which cable 58 will be received by a large (or small) diameter portion of the cam rail or at which the distance X will be relatively large (or small) will also be repositioned. In this manner, the point(s) or location(s) of the cam rail rotation (e.g., measured in degrees of rotation from the rest position of the cam rail) at which a relatively large or a relatively small resistance to the rotation (and to the limb motion) is applied may be adjusted.

The handle structure 22 is designed to provide a high degree of wrist freedom so as not to restrict a golfers wrist movement during the golf stroke. Alternatively, movement of a golfers wrist may be restricted or forbidden, as discussed above with reference to the FIG. 4 structure. The angle and height adjustment structure 18 is provided to adjust the angle A of swing arm 90 (and the angular orientation of the plane in which swing arm 90 pivots) and the height of the cam and multiple arm structure 20 so as to accommodate golfers of various heights and figures.

In a preferred embodiment, a practice mat 228 (FIG. 1) may be provided between the first and second stabilizer feet 44 and 46. An illustration of a practice ball 230 may be printed on the practice mat so that the golfer may practice aligning the head of the golf club to the golf ball as the handle structure is swung through the downstroke portion of the golf stroke. Preferably, the golf club head is brightly colored, or white so as to produce a visual image of a trail over a darker colored mat 228 as the club head moves across the mat. In this manner, the golfer can readily determine if the club head is open or closed and can determine if the head is moving in a desired path at the point of impact.

Additional embodiments of the invention may include similar apparatus as described, but may eliminate the stabilizer feet 44 and 46. In such embodiments, other means for stabilizing the weight rack structure, where necessary, may be employed, such as bolts or stakes or the like for connecting the base members 48 and 50 to a floor structure or to the ground. Alternatively, the framework provided by vertical frame members 24 and 26 and horizontal frame members 28 and 30 may be secured to a wall structure, thus, obviating the need for the weight rack support structure 14.

In yet another embodiment, angle braces 54 and 56 are connected to base member 48 and stabilizer feet 44 and 46 are eliminated, shortened, or positioned to extend to the right (with respect to FIG. 1) from the weight rack structure 12 so that golfer 104 may actually hit a practice ball from practice mat 228. Stabilizer feet 44 and 46 may be provided with a plurality of apertures (not shown) along their lengths and may be secured to base members 48 and 50 with torque bolts extending through respective apertures in feet 44 and 46. In this embodiment, the length at which each stabilizer foot 44 and 46 extends toward golfer 104 may be selectively adjusted by selecting which apertures in feet 44 and 46 the torque bolts are extended.

In an alternative embodiment, weight rack structure 12 is disposed within a cabinet, e.g., at a driving range facility or a gym facility, and can be stored within the cabinet by pivoting support arm 82 into its most vertical position and by rotating swing arm 90 180° with respect to the rest position. This position will be referred to as the storage position. Swing arm 90 can be locked into a storage position by a storage stop mechanism similar to the second stop mechanism 220 described with reference to FIG. 3, however, mounted at the opposite end of swing arm 90 with respect to the end at which the above described second stop mechanism 220 is mounted. Prior to operation, the cabinet structure is opened, support arm 82 is pivoted to a desired angle and swing arm 90 is released from its storage position.

According to another embodiment of the invention, the weight rack structure is eliminated and cable 58 is connected to another type of resistance device, such as a spring or pneumatic damper. Alternatively, cable 58 can be connected to a horizontal bar which is lifted vertically as the cable is pulled and which is adapted to receive one or more weight members, such as disc-shaped weights having a central aperture through which the horizontal bar extends. Other suitable types of resistance or weight devices are also contemplated to be employed with the invention.

Cam rail 126 illustrated in the Figures has a substantially symmetrical outer peripheral shape. As a result, cable 58 may be secured to the right side (with respect to FIG. 2) of cam rail 126 for a right-handed golfer, or to the left side (with respect to FIG. 2) of cam rail 126 for a left-handed golfer without removing the cam rail. Other embodiments of cam rail 126 may not have a symmetrical outer peripheral shape. For such other cam rail embodiments, the apparatus may be changed from a right-handed apparatus to a left-handed apparatus (and vice-versa) by either replacing the cam rail with a suitable rail or by removing, flipping over and remounting the cam rail.

While the above discussion and FIGS. 1–7 relate primarily to a golf swing exercising and training device, it will be recognized that the apparatus can be readily adapted for other limb movements. For example, suitable handles, foot racks, kick plates or the like can be adapted to rotate the cam wheel structure and, thereby operate on the weight rack structure (or other suitable resistance devices) in manners similar to the manner discussed above. Accordingly, components of the golf swing exercising and training apparatus discussed above may be readily employed in exercising and training devices, such as for arm swings for a baseball bat stroke, arm swings for a tennis racket stroke, arm swings for a polo club stroke, arm swings for a baseball throw or pitch, arm swings involved in swimming, boxing or martial arts, or arm swings involved in other types of sporting activities. The apparatus can also be adapted for exercising and training leg swings, such as a kicking stroke, a running stroke, a walking stroke, a swimming stroke, or the like. The apparatus can be designed for improving and training a limb stroke for a sporting activity, as well as for improving and training a limb stroke for medical or therapeutic purposes. The apparatus provides a resistance to the limb motion which may vary (have greater resistance points and lower resistance points) over the stroke of the limb motion. Furthermore, the apparatus allows adjustment of the location(s) over the limb stroke of the greater resistance points and lower resistance points.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An exercise apparatus for exercising a user's muscles employed in a specific limb motion, the apparatus comprising:

a cam wheel structure having a cam axis and being supported for rotation about the cam axis;

motion transferring means for transferring the limb motion to a rotation motion for rotating the cam wheel structure a plurality of degrees of rotation; and resistance means operatively coupled to the cam wheel structure for providing a resistance force to resist rotation of the cam wheel structure;

wherein the cam wheel structure comprises control means for controlling the resistance to the rotation of the cam wheel structure to provide a relatively large resistance during a first portion of the cam wheel structure rotation and a relatively small resistance during a second portion of the cam wheel structure rotation;

wherein the cam wheel structure further comprises adjustment means for adjusting the position of the first and second portions of the cam wheel structure rotation over the plurality of degrees of rotation;

wherein the control means comprises a substantially oval shaped cam rail having a large diameter portion, a small diameter portion and an eccentrically located axis of rotation adjacent the small diameter portion; and wherein the cam wheel structure rotates from a rest position upon the limb motion being transferred to a rotation motion and wherein the adjustment means comprises means for adjusting the position of the cam wheel structure at the rest position.

2. An exercise apparatus for exercising a user's muscles employed in a specific limb motion, the apparatus comprising:

a cam wheel structure having a cam axis and being supported for rotation about the cam axis;

motion transferring means for transferring the limb motion to a rotation motion for rotating the cam wheel structure a plurality of degrees of rotation; and resistance means operatively coupled to the cam wheel structure for providing a resistance force to resist rotation of the cam wheel structure;

wherein the cam wheel structure comprises control means for controlling the resistance to the rotation of the cam wheel structure to provide a relatively large resistance during a first portion of the cam wheel structure rotation and a relatively small resistance during a second portion of the cam wheel structure rotation;

wherein the cam wheel structure further comprises adjustment means for adjusting the position of the first and second portions of the cam wheel rotation over the plurality of degrees of rotation;

wherein the motion transferring means comprises:

a handle to be gripped and swung by the user;

a handle connecting arm connected with the handle;

a swing arm connected at approximately a right angle with the handle connecting arm so as to be operatively connected to the handle, the swing arm being supported for pivotal motion about the cam axis as the handle is swung; and a cam axle supported for rotation about the cam axis, the cam axle being operatively coupled to the swing arm to rotate about the cam axis as the swing arm is pivoted, the cam axle being connected to the cam wheel structure to rotate the cam wheel structure about the cam axis as the cam axle is rotated about the cam axis.

3. Apparatus as claimed in claim 2, wherein the swing arm comprises an elongated arm; and wherein the handle connecting arm has a first end connected to the handle, a second end connected to the swing arm at a location along the length of the swing arm, and means for adjusting the location along the length of the swing arm at which the handle connecting arm connects.

4. An exercise apparatus disposed over a horizontal surface for exercising a user's muscles employed in a specific limb motion, the apparatus comprising:

a cam wheel structure having a cam axis and being supported for rotation about the cam axis;

motion transferring means for transferring the limb motion to a rotation motion for rotating the cam wheel structure a plurality of degrees of rotation;

resistance means operatively coupled to the cam wheel structure for providing a resistance force to resist rotation of the cam wheel structure;

wherein the cam wheel structure comprises control means for controlling the resistance to the rotation of the cam wheel structure to provide a relatively large resistance during a first portion of the cam wheel structure rotation and a relatively small resistance during a second portion of the cam wheel structure rotation;

wherein the cam wheel structure further comprises adjustment means for adjusting the position of the first and second portions of the cam wheel structure rotation over the plurality of degrees of rotation;

wherein the motion transferring means comprises a handle to be gripped and swung by the user, a swing arm extending at an angle with respect to the horizontal surface and operatively connected to the handle and supported for pivotal motion about the cam axis as the handle is swung, and a cam axle supported for rotation about the cam axis, the cam axle being operatively coupled to the swing arm to rotate about the cam axis as the swing arm is pivoted, the cam axle being connected to the cam wheel structure to rotate the cam wheel structure about the cam axis as the cam axle is rotated about the cam axis;

the apparatus further comprising:

a support arm for supporting the cam wheel structure, the cam axis and the swing arm;

the support arm having means for adjusting the angle at which the swing arm extends with respect to the horizontal surface; and the support arm further having means for adjusting the height of the support arm above the horizontal surface.

5. An exercising apparatus comprising:

a handle;

a cam wheel having an axis of rotation and supported for rotation about the axis;

a swing arm operatively supporting the handle for swinging motion and operatively connecting the handle with the cam wheel so as to rotate the cam wheel about the axis as the handle is moved in a swinging motion;

resistance means for providing a resistance force resisting rotational motion of the cam wheel;

a support arm for supporting the cam wheel with the cam axis directed at an angle with respect to a horizontal plane at the cam axis; and means for pivoting the support arm to adjust the angle of the cam axis with respect to the horizontal plane.

6. Apparatus as claimed in claim 5, wherein the cam wheel comprises control means for controlling the resistance to the rotation of the cam wheel structure to provide a relatively large resistance during a first portion of the cam wheel rotation and a relatively small resistance during a second portion of the cam wheel rotation; and wherein the cam wheel further comprises adjustment means for adjusting the position of the first and second portions of the cam wheel rotation over the plurality of degrees of rotation.

7. Apparatus as claimed in claim 5, wherein:

the handle comprises a golf club type handle; and the swing arm operatively supports the handle for a swinging motion which simulates a golf club swing.

8. Apparatus as claimed in claim 5, further comprising:

a handle connecting arm having first and second ends, the first end being coupled to the swing arm; and pivotal connecting structure for connecting the handle to the second end of the handle connecting arm for allowing pivotal motion of the handle with respect to the handle connecting arm.

9. Apparatus as claimed in claim 5, wherein the resistance means comprises:

a weight member;

a cable connected to and extended between the weight member and the cam wheel; and a cable guide for guiding the cable to lift the weight member by an amount dependent upon the amount of rotation of the cam wheel about the axis;

wherein the weight member provides a resistance force through the cable for resisting the rotation of the wheel and for resisting the swinging motion of the handle.

10. Apparatus as claimed in claim 9, wherein:

the cam wheel has an arcuate periphery;

the cable is coupled to the arcuate periphery of the cam wheel;

the rotation of the cam wheel pulls a length of the cable to lift the weight by an amount dependent on the length of the cable pulled; and the length of cable pulled per degree of cam wheel rotation is dependent on the outer peripheral shape of the cam wheel.

11. Apparatus as claimed in claim 10, wherein:

the arcuate periphery of the cam wheel is substantially oval shaped;

the cam wheel is rotatable by a plurality of degrees of rotation; and the length of cable pulled per degree of rotation of the cam wheel varies over the plural degrees of rotation.

12. Apparatus as claimed in claim 10, wherein:

the axis of rotation of the cam wheel is eccentrically located with respect to the arcuate periphery of the cam wheel;

the cam wheel is rotatable by a plurality of degrees of rotation; and the length of cable pulled per degree of rotation of the cam wheel varies over the plural degrees of rotation.

13. An exercising apparatus as claimed in claim 9, wherein the cam wheel is provided with a plurality of apertures and wherein the cable is provided with a hook configured to selectively engage any one of the plural apertures of the cam wheel so as to connect the cable to the cam wheel at a selected location on the cam wheel, the location being selected in dependence on the aperture selected for engagement with the hook.

14. An exercising apparatus as claimed in claim 5, further comprising a handle connecting arm connected to the swing arm, wherein the handle is one of a plurality of interchangeable handles and the apparatus further comprises a handle connector for connecting any one of the plural handles to the handle connected arm.

15. An exercising apparatus as claimed in claim 14, wherein each handle is configured different than any other handle of the plural handles such that a handle having a particular desired configuration can be selected from the plural handles and connected to the support means.

16. Apparatus as claimed in claim 5 further comprising a pivotal plate pivotally connected to the swing arm and pivotal between a first position at which the plate contacts the support arm and inhibits motion of the swing arm relative to the support arm, and a second position at which the plate is out of direct contact with the support arm.

17. Apparatus as claimed in claim 5, further comprising a frame member, wherein the means for pivoting the support arm comprises a hinge support structure pivotally connecting the support arm with the frame member such that the support arm is pivotal with respect to the frame member to vary the angle between the support arm and frame member.

18. An exercising apparatus as claimed in claim 8, wherein the handle comprises:

an elongated member supported by the handle connecting arm and movable in the axial direction of the elongated member; and a spring mechanism mounted to the elongated member to urge the elongated member along the axial direction of the elongated member.

19. An exercising apparatus comprising:

a handle;

support means for supporting the handle for swinging motion;

a cam wheel having an arcuate periphery and an axis for rotation, the cam wheel being supported for rotation about the axis;

linkage connecting the handle with the wheel so as to rotate the wheel about the axis as the handle is moved in a swinging motion;

a weight member;

a cable connected to and extended between the weight member and the cam wheel, the cable being connected to the arcuate periphery of the cam wheel;

a cable guide for guiding the cable to lift the weight member by an amount dependent upon the amount of rotation of the cam wheel about the axis;

wherein the weight member provides a resistance force through the cable for resisting the rotation of the wheel and for resisting the swinging motion of the handle;

wherein the support means comprises a swing arm pivotally supported for pivotal motion about the axis of the cam wheel, a handle connecting arm having first and second ends, the first end being coupled to the swing arm, and wherein a ball joint assembly connects the handle to the second end of the handle connecting arm for allowing pivotal motion of the handle with respect to the handle connecting arm.

20. An exercising apparatus comprising:

a handle;

support means for supporting the handle for swinging motion;

a cam wheel having an arcuate periphery and an axis for rotation, the cam wheel being supported for rotation about the axis;

linkage connecting the handle with the cam wheel so as to rotate the cam wheel about the axis as the handle is moved in a swinging motion;

a weight member;

a cable connected to and extended between the weight member and the cam wheel, the cable being connected to the arcuate periphery of the cam wheel; and a cable guide for guiding the cable to lift the weight member by an amount dependent upon the amount of rotation of the cam wheel about the axis;

wherein the weight member provides a resistance force through the cable for resisting the rotation of the cam wheel and for resisting the swinging motion of the handle;

wherein the support means comprises a swing arm pivotally supported for pivotal motion about the axis of the cam wheel, a handle connecting arm having first and second ends, the first end being coupled to the swing arm;

pivotal connecting means for connecting the handle to the second end of the handle connecting arm for allowing pivotal motion of the handle with respect to the handle connecting arm;

wherein the support means further comprises:

a support arm for supporting the cam wheel and the swing arm;

an elongated substantially vertical member;

a slide-member coupled to the substantially vertical member and slidable along the length of the substantially vertical member;

a pressure plate interposed between the slidable member and the substantially vertical member; and at least one bolt extending through the slidable member and in contact with the pressure plate, the bolt being adapted to press against the pressure plate to force the pressure plate against the substantially vertical member to fix the slidable member to the substantially vertical member.

21. A method for exercising user's muscles employed in a specific limb motion, the method comprising the steps of:

supporting a cam wheel structure on a support arm for rotation a plurality of degrees about a cam axis;

pivoting the support arm with respect to a frame member to adjust the angle of the cam axis with respect to the frame member to accommodate the specific limb movement;

transferring the limb motion to a rotational motion of the cam wheel about the cam axis; and resisting cam wheel rotation.

22. A method as claimed in claim 21, wherein the step of resisting cam wheel rotation comprises the steps of resisting cam wheel rotation with a relatively large resistance force during a first portion of the cam wheel rotation and a relatively small resistance force during a second portion of the cam wheel rotation, and wherein the method further comprises the step of adjusting the position of the first and second portions of the cam wheel rotation over the plurality of degrees of rotation.

23. A method as claimed in claim 22, wherein the cam wheel structure is rotatable a plurality of degrees from a rest position and said step of adjusting comprises the step of adjusting the orientation of the cam wheel at the rest position.

24. An exercising apparatus comprising:

a handle;

support means for supporting the handle for swinging motion;

a cam wheel having an arcuate periphery and axis of rotation, the cam wheel being supported for rotation about the axis;

linkage connecting the handle with the wheel so as to rotate the wheel about the axis as the handle is moved in a swinging motion;

a weight member;

a cable connected to and extended between the weight member and the cam wheel, the cable being connected to the arcuate periphery of the cam wheel; and a cable guide for guiding the cable to lift the weight member by an amount dependent upon the amount of rotation of the cam wheel about the axis;

wherein the weight member provides a resistance force through the cable for resisting the rotation of the wheel and for resisting the swinging motion of the handle;

wherein the arcuate periphery of the cam wheel is provided with a plurality of apertures and wherein the cable is provided with a hook configured to selectively engage any one of the plural apertures of the cam wheel so as to connect the cable to the cam wheel at a selected location on the cam wheel, the location being selected in dependence on the aperture selected for engagement with the hook.

25. An exercising apparatus comprising:

a cam wheel having an arcuate periphery and an axis for rotation, the cam wheel being supported for rotation about the axis;

a swing arm operatively connected to the cam wheel and supported for swinging motion and for rotating the cam wheel about the cam wheel axis upon being moved in a swinging motion;

a handle having a grip, an elongated shaft extending from the grip and a coil spring disposed around a portion of the length of the shaft; and a handle connecting arm connecting the handle to the swing arm, the handle connecting arm having a slidable connector connected to the elongated shaft between the grip and the coil spring for sliding motion of the shaft relative to the handle connecting arm.

26. An exercising apparatus comprising:

a handle;

a cam wheel having an arcuate periphery and an axis for rotation, the cam wheel being supported for rotation about the axis;

support and linkage means for supporting the handle for swinging motion and for connecting the handle with the wheel so as to rotate the wheel about the axis as the handle is moved in a swing motion;

resistance means for resisting the rotation of the wheel and for resisting the swinging motion of the handle;

wherein the support and linkage means comprises a swing arm pivotally supported for pivotal motion about the axis of the cam wheel, a handle connecting arm having first and second ends, the first end being coupled to the swing arm, and wherein a ball joint assembly connects the handle to the second end of the handle connecting arm for allowing pivotal motion of the handle with respect to the handle connecting arm.

* * * * *